United States Patent [19]

Igata et al.

[11] Patent Number: 4,620,885

[45] Date of Patent: Nov. 4, 1986

[54] SPRING MATERIAL FOR ELECTRIC AND ELECTRONIC PARTS

[75] Inventors: Naohiro Igata, 15-1, Nishioga-Kita 1-chome, Suginami-Ku, Tokyo, Japan; Shinji Sato, Chiba, Japan

[73] Assignees: Nakasato Limited; Naohiro Igata, both of Tokyo, Japan

[21] Appl. No.: 813,921

[22] Filed: Dec. 27, 1985

[30] Foreign Application Priority Data

Nov. 19, 1985 [JP] Japan ..... 60-257544

[51] Int. Cl.[4] ..... C22C 0/9

[52] U.S. Cl. ..... 148/435; 148/414; 420/488; 420/492; 420/472; 420/473

[58] Field of Search ..... 148/435, 414; 420/488, 420/492, 472, 473, 469, 495, 499

[56] References Cited

U.S. PATENT DOCUMENTS

| | | | |
|---|---|---|---|
| 1,151,744 | 8/1915 | Vickers | 420/492 |
| 2,102,238 | 12/1937 | Pilling et al. | 148/414 |
| 2,309,103 | 1/1943 | Crampton et al. | 148/414 |
| 2,375,285 | 5/1945 | Crampton et al. | 148/414 |

FOREIGN PATENT DOCUMENTS

| | | | |
|---|---|---|---|
| 3429393A1 | 2/1985 | Fed. Rep. of Germany | 420/492 |
| 59-140338 | 11/1984 | Japan | 420/488 |
| 59-140340 | 11/1984 | Japan | 420/488 |
| 60-39140 | 2/1985 | Japan | 420/492 |

*Primary Examiner*—Veronica O'Keefe

*Attorney, Agent, or Firm*—Stevens, Davis, Miller & Mosher

[57] ABSTRACT

A spring material for electric and electronic parts having a high modulus of elasticity and good electrical conductivity. The material is made by melting Cu, Ni, Ti or mother alloy thereof and Cu—P as deoxidizer at a temperature between a melting point and 1,400° C. to obtain a molten alloy consisting of 0.5~2.0% by weight of Ni, 0.1~1.0% by weight of Ti, less than 0.2% by weight of P and the remainder being Cu; casting the molten alloy into a metal mold to obtain an ingot; subjecting the ingot to hot (or warm) working, cold working and annealing; and finally rolling the annealed sheet above 50% and annealing it at low temperature with air cooling to obtain a formed product having a stable structure.

1 Claim, 6 Drawing Figures

SPRING MATERIAL FOR ELECTRIC AND ELECTRONIC PARTS

BACKGROUND OF THE INVENTION

1. Field of the Invention

The present invention relates to a spring material for electric parts having a high modulus of elasticity, good electrical conductivity and a good spring limit value, and a method of producing the above spring material in an inexpensive manner.

2. Related Art Statement

Heretofore, as the spring material for electric parts, there has been known a phosphor bronze such as PBP alloy (5.5~7.0% by weight of Sn, 0.03~0.35% by weight of P, and the remainder of Cu) and PBS alloy (7.0~9.0% by weight of Sn, 0.03~0.35% by weight of P and the remainder of Cu), and Be—Cu alloy (for instance, 2.0% by weight of Be and the remainder of Cu).

However, the spring material mentioned above does satisfy the requirement for a high modulus of elasticity and good electrical conductivity now required for the spring material for electric parts. Additionally, the spring material of the prior art mentioned above is expensive.

SUMMARY OF THE INVENTION

The present invention has for its object to eliminate the drawbacks mentioned above and to provide a spring material for electric and electronic parts having a high modulus of elasticity, good electrical conductivity and a good spring limit value.

According to the invention, a spring material for electric and electronic parts having a high modulus of elasticity and good electrical conductivity, consists of 0.5~2.0% by weight of Ni, 0.1~1.0% by weight of Ti, less than 0.2% by weight of P and the remainder of Cu.

Another object of the invention is to provide a method of producing the spring material for electric parts in an inexpensive manner.

According to the invention, a method of producing a spring material for electric parts having a high modulus of elasticity and a good electrical conductivity, comprises the steps of melting Cu, Ni, Ti or mother alloy thereof and Cu—P as a deoxidizer at a temperature between a melting point 1,080° C. and 1,400° C. to obtain a molten alloy consisting of 0.5~2.0% by weight of Ni, 0.1~1.0% by weight being Ti, less than 0.2% by weight of P and the remainder of Cu;

casting said molten alloy into a metal mold to obtain an ingot;

subjecting said ingot to hot (or warm) working, cold working and annealing corresponding to an amount of said total cold working to obtain a sheet;

rolling said annealed sheet at more than 50% reduction rate as a final working to obtain a formed product; and heating said formed product at a temperature between 200° C. and 500° C. for less than one hour and cooling with an air cooling rate to obtain a formed product having a stable structure.

DESCRIPTION OF THE PREFERRED EMBODIMENTS

A spring material according to the invention is manufactured in the following manner. At first, about 2 kg of raw materials including oxygen-free copper, Cu-25Ti, Cu-30Ni as mother alloys and Cu—P as a deoxidizer are supplied into a crucible made of graphite, and are then melted in argon atmosphere at a temperature between 1,200° C. and 1,400° C. by means of a high frequency induction furnace to obtain a molten alloy consisting of 0.5~2.0% by weight of Ni, 0.1~1.0% by weight of Ti, less than 0.2% by weight of P and the remainder of Cu. The molten alloy thus obtained is cast in a stainless steel mold of the desired shape and design to obtain a specimen. Then, the specimen is subjected to a warm rolling or a cold rolling, and is further subjected to an intermediate annealing at a temperature below 550° C. for less than one hour. Finally, the specimen is rolled at 50~95% reduction. The finally rolled specimen is annealed at a temperature between 200° C. and 550° C. for less than one hour to obtain a stable structure and to increase the value of elastic limit in bending up, and then is air-cooled.

Figure 1:
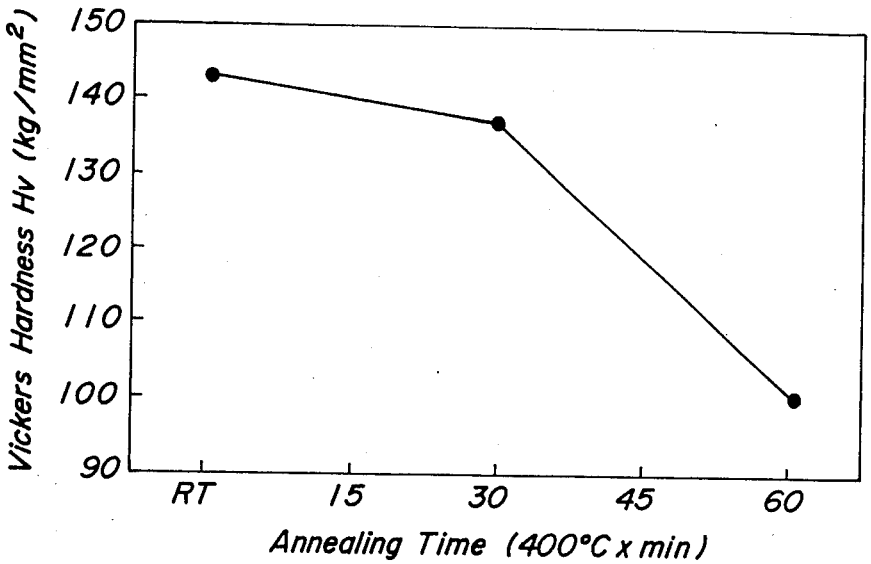
FIG. 1 is a graph showing a measurement result of vickers hardness for determining a condition of intermediate annealing with respect to a spring material according to the invention.

In this case, since a condition of the intermediate annealing mentioned above largely influences the strength of the spring material, it is necessary to select suitable temperature and time conditions corresponding to an amount of the cold working effected just prior to intermediate annealing. For example, a measurement result of vickers hardness for determining a condition of the intermediate annealing with respect to the specimen is shown in FIG. 1. In FIG. 1, it seems that an abrupt decrease in vickers hardness of the specimen annealed for 60 minutes is due to a growth of recrystallization. As a result, the intermediate annealing at 400° C. for 30 minutes is effective for all the specimens used in following embodiments.

MECHANISMS

As mentioned above, the spring material having the high modulus of elasticity, good electrical conductivity and good spring limit value can be obtained by rolling the alloy having specific compositions at more than 50%, preferably 70~95% reduction and by annealing the rolled alloy at relatively low temperature. In this case, the reasons for limiting an amount of Ni, Ti, P are as followings. At first an addition of Ni increases the modulus of elasticity and the strength, but excess addition of Ni reduces the electrical conductivity, so that an amount of Ni is limited to 0.5~2.0% by weight. Then, an addition of Ti increases the strength and the spring limit value, but excess Ti reduces the modulus elasticity and electrical conductivity, so that an amount of Ti is limited to 0.1~1.0% by weight. Further, an addition of P improves castability, but the excess P decreases the modulus of elasticity, so that the amount of P is limited to less than 0.2% by weight.

MEASUREMENT METHOD

Hereinafter, the methods of measuring various characteristics of the spring material produced in the manner mentioned above and the results of measurements will be explained.

1. Measurement of Young's modulus (elasticity)

Figure 2:
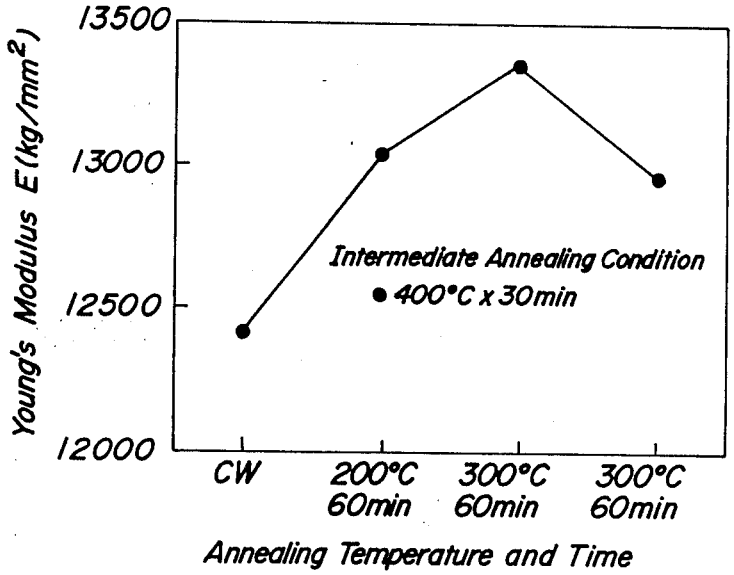
FIG. 2 is a graph illustrating a relation between Young's modulus and a condition of final annealing according to the invention.

An amount of flexure of a cantilever specimen is measured under the condition that a weight (50 g) is set at a position, the distance of which is one hundred times the thickness of the specimen from the supporting position. Young's modulus is obtained from an equation as below on the basis of the measured flexure amount.

$$E = \frac{4W}{bf} \times \frac{L^3}{t}$$

where E: Young's modulus (kg/mm$^2$), W: weight (0.015 kg), L: length of specimen (mm), f: flexure displacement (mm), b: specimen width (=10 mm), t: specimen thickness (mm). The measurement result of Young's modulus is shown in FIG. 2 by a relation between temperature of the final annealing and time. As shown in FIG. 2, the maximum Young's modulus is obtained from the specimen annealed at 300° C. for 30 minutes. Therefore, measurements of various characteristics mentioned below are performed by using the spring material annealed at the condition mentioned above.

2. Measurement of spring limit value (in bending)

A spring limit value Kb is obtained from a permanent deformation δ and a moment M calculated from the permanent deformation δ. Here, $$\delta = (\tfrac{1}{4} \times 10^4) \times (L^2/t)$$

where δ is a flexure amount at $\sigma = 0.375$ (E/10$^4$) kg/mm$^2$. The moment M is obtained from an equation mentioned below on the basis of the flexure amount δ.

$$M = M_1 + \Delta M(\delta - \epsilon_1)/(\epsilon_2 - \epsilon_1)$$

where M: moment corresponding to the spring limit value, $M_1$: moment on $\epsilon_1$ (mm·kg), ΔM: $M_2 - M_1$, $M_2$: moment on $\epsilon_2$ (mm·kg), $\epsilon_1$: maximum value among permanent flexures up to δ, $\epsilon_2$: minimum value among permanent flexures above δ. The spring limit value Kb is obtained from an equation mentioned below on the basis of the moment M.

$$Kb = \frac{M}{Z}$$

where Z: section modulus and $Z = bt^2/6$, b: specimen width (mm), t: specimen thickness (mm). The spring limit values Kb of the specimen according to the invention are all above 40 kg/mm$^2$.

3. Measurement of hardness

By using a micro vickers hardness tester, the measurement of vickers hardness is performed under the condition that the weight is 25 g. The vickers hardness thus measured for the specimens annealed at 300° C. for 30 minutes are all above Hv=150 kg/mm$^2$.

4. Measurement of tensile strength

Figure 3:
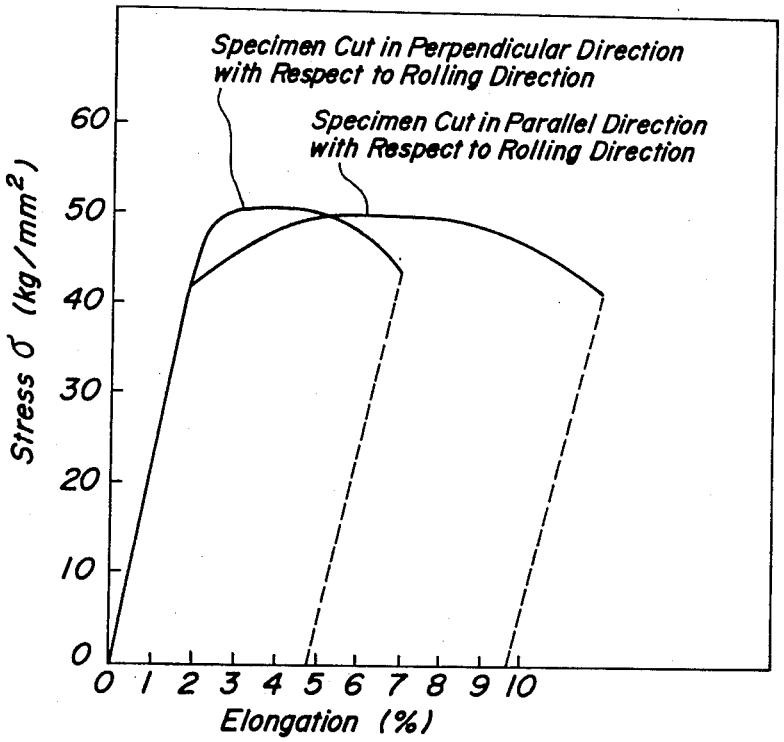
FIG. 3 is a graph depicting a measurement result of a tension test according to the invention.

A tension test is performed for the specimens cut in a perpendicular and a parallel directions with respect to the rolling direction in such a manner that the specimen having a parallel portion of 0.3 mm×5 mm×20 mm is tensile tested by an instron-type tension tester using a strain rate of $4 \times 10^{-3}$ sec$^{-1}$. The result obtained is shown in FIG. 3. As shown in FIG. 3, the tensile strengths of the spring material thus obtained are all above 50 kg/mm$^2$, and the elongations thereof are all above 9%.

5. Measurement of remaining stress

Figure 4:
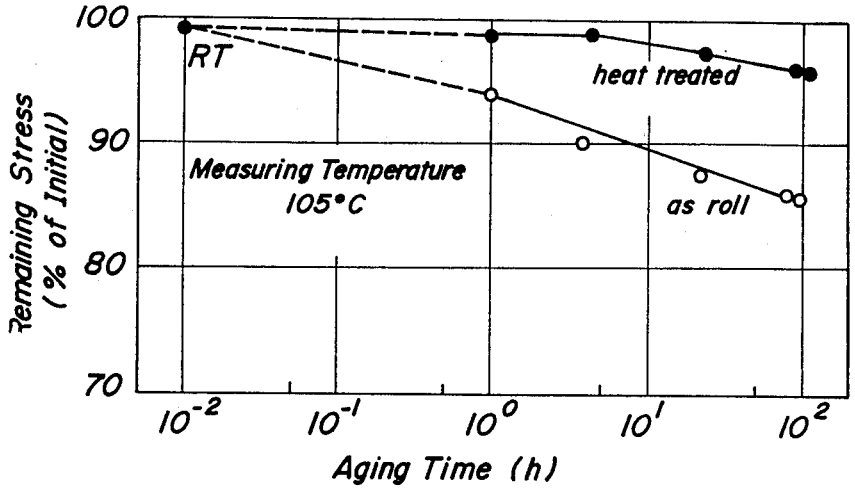
FIG. 4 is a graph showing a relation between a remaining stress and an ageing time.

After the specimen is set to a measurement holder, it is maintained at 105° C. in a thermostat, and then a remaining stress (RS) corresponding to the holding time is obtained from an equation mentioned below.

$$RS = \frac{\delta_1 - \delta_2}{\delta_1} \times 100$$

where $\delta_1$ is an applied deformation and $\delta_2$ is a remaining deformation after eliminating the deformation. The result obtained is shown in FIG. 4. Since the electric parts using the spring material are to be used for a long time, the spring material having the small remaining stress is desired. As shown in FIG. 4, the spring material according to the invention has a satisfactorily small remaining stress.

6. Measurement of electrical conductivity

Resistance is measured in such a manner that a current 1A flows in a parallel portion of a specimen of 0.3 mm×10 mm×150 mm. The electrical conductivities of the spring material according to the invention are all above 45IACS% (IACS%: conductivity ratio with respect to a pure copper).

Table 1 below shows a comparison table between the spring material according to the invention (CNT) and the known phosphor bronze (PBP and PBS) for various characteristics mentioned above, together with some standard alloys.

TABLE 1

| Material | CNT | PBP JIS C-5191 | PBS JIS C-5210 | UNS C51000 | ASTM C52100 | UNS C72500 | DIN CuSn6 | DIN CuSn8 |
|---|---|---|---|---|---|---|---|---|
| Composition | Ni: 0.5–2.0<br>Ti: 0.1–1.0<br>P: 0.2<br>Cu: balance | Sn: 5.5–7.0<br>P: 0.03–0.35<br>Cu: balance | Sn: 7.0–9.0<br>P: 0.03–0.35<br>Cu: balance | Sn: 5<br>P: 0.2<br>Cu: 94.8 | Sn: 7.0–9.0<br>Zn: ≦0.20<br>Fe: ≦0.10<br>Pb: ≦0.05<br>P: 0.03–0.35 | Sn: 2.3<br>Ni: 9.5<br>Cu: 88.2 | Sn: 5.5–7.5<br>P:0.01–0.4<br>Cu: balance | Sn: 7.5–9.0<br>P: 0.01–0.4<br>Cu: balance |
| Tensile strength (kg/mm$^2$) | more than 60 | more than 60 | more than 65 | | | | 55–65 | 59–69 |

TABLE 1-continued

| Material | CNT | PBP JIS C-5191 | PBS JIS C-5210 | UNS C51000 | ASTM C52100 | UNS C72500 | DIN CuSn6 | DIN CuSn8 |
|---|---|---|---|---|---|---|---|---|
| (ksi) | | | | 76–91 | 85–100 | 68–83 | | |
| Elongation (%) | more than 8 | more than 8 | more than 8 | 4–11 | 12–30 | 2–13 | more than 8 ($A_{10}$) | more than 7 ($A_{10}$) |
| Modulus of elasticity (kg/mm$^2$) | more than 13,000 | more than 11,000 | more than 10,000 | | | | | |
| ($10^6$ psi) | | | | 16 | 16 | 20 | — | — |
| Electrical conductivity (IACS %) | more than 40 | 11–13 | 10–12 | 15 | 13 | 11 | — | — |
| Spring limit value $K_b$ (kg/mm$^2$) | more than 50 | — | more than 40 | — | — | — | — | — |
| Vickers hardness (Hv) | more than 180 | more than 170 | more than 185 | 175–205 | 190–220 | 155–185 | 180–210 | 190–220 |
| Cost (CNT = 100) | 100 | 130 | 150 | — | — | — | — | — |

As clearly understood from the Table 1, CNT according to the invention satisfies the high modulus of elasticity, the requirements for a good electrical conductivity and the small remaining stress requirement for spring material for electric Parts. Additionally CNT is inexpensive in cost, as compared with PBP, PBS.

Figure 5:
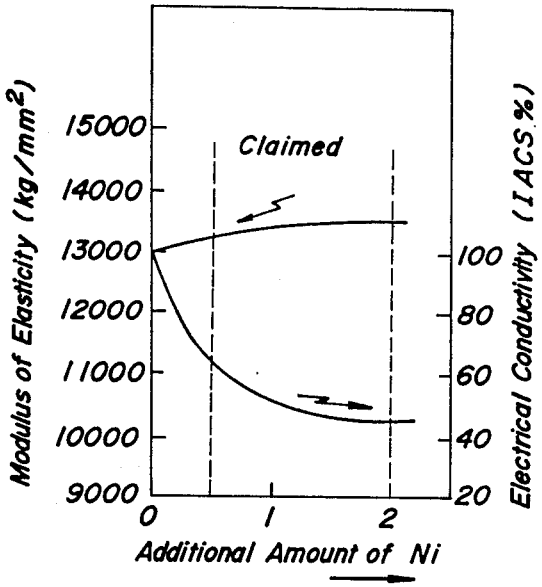
FIG. 5 is a graph illustrating a relation of an amount of Ni vs. modulus of elasticity and electrical conductivity.
Figure 6:
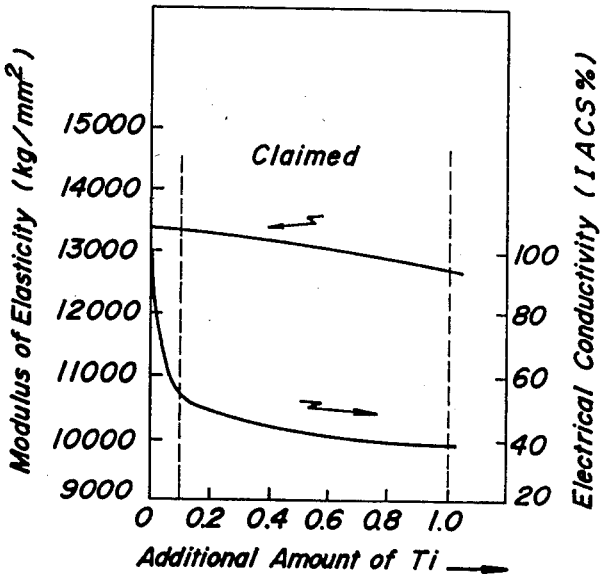
FIG. 6 is a graph depicting a relation of an amount of Ti vs. modulus of elasticity and electrical conductivity.

FIGS. 5 and 6 show a relation of an amount of Ni vs. modulus of elasticity and electrical conductivity, and a relation of an amount of Ti vs. modulus of elasticity and electrical conductivity, respectively. As can be seen from FIGS. 5 and 6, the spring material having a specific composition in claimed range has the high modulus of elasticity and the good electrical conductivity. Further, a few examples of data used for determining various characteristics are shown in Table 2.

TABLE 2

| Specimen No. | Composition (wt %) | | Young's modulus (kg/mm$^2$) | Tensile strength (kg/mm$^2$) | Elongation (%) | Electrical conductivity (IACS %) |
|---|---|---|---|---|---|---|
| 1 | Ni: 0.9, Cu: balance, | Ti: 0.13 (P: trace) | 13,360 | 51.2 | 9.6 | 47.6 |
| 2 | Ni: 1.0, P: trace, | Ti: 0.5 Cu: balance | 13,100 | 60.0 | 8.5 | 42.0 |
| 3 | Ni: 2.0, P: trace, | Ti: 0.5 Cu: balance | 13,450 | 70.5 | 8.0 | 40.0 |
| PBS | Sn: 8.0, Cu: balance | P: 0.2 | 10,200 | 70.0 | 9.0 | 12.0 |

As mentioned above, according to the invention, it is possible to obtain the spring material for electric and electronic parts which satisfies requirement for high modulus of elasticity, good electrical conductivity, small remaining stress and inexpensive cost.

What is claimed is:

1. A spring material for electric and electronic parts having a high modulus of elasticity and a good electrical conductivity, consisting of 0.5~2.0% by weight of Ni, 0.1~1.0% by weight of Ti, less than 0.2% by weight of P and the remainder being Cu.

* * * * *